United States Patent [19]

Den Besten et al.

[11] Patent Number: 4,961,542

[45] Date of Patent: Oct. 9, 1990

[54] MATERIAL REDUCER

[75] Inventors: Todd Den Besten, Schodack, N.Y.; Leroy E. DenBesten, Westlyn Grove, Box 344, Valatie, N.Y. 12184

[73] Assignee: Leroy E. DenBesten, Castleton, N.Y.

[21] Appl. No.: 306,450

[22] Filed: Feb. 3, 1989

[51] Int. Cl.[5] ..... B02C 21/00

[52] U.S. Cl. ..... 241/101.7; 241/200

[58] Field of Search ..... 241/101.7, 239, 200, 241/240, 101 A, 243, 223, 276

[56] References Cited

U.S. PATENT DOCUMENTS

| | | | |
|---|---|---|---|
| 2,646,913 | 7/1953 | Goldberg et al. | 241/101 A X |
| 4,171,104 | 10/1979 | Kunitsyn et al. | 241/243 X |
| 4,183,472 | 1/1980 | Packard et al. | 241/223 X |
| 4,511,302 | 4/1985 | Moore | 241/101.7 X |

FOREIGN PATENT DOCUMENTS

| | | | |
|---|---|---|---|
| 528821 | 8/1956 | Canada | 241/200 |
| 116760 | 12/1926 | Switzerland | 241/200 |

*Primary Examiner*—Mark Rosenbaum

*Attorney, Agent, or Firm*—Kane, Dalsimer, Sullivan, Kurucz, Levy, Eisele and Richard

[57] ABSTRACT

A material reducing apparatus includes a hopper having a pair of opposed sides, a front end and a back end. The back end has a top and bottom and a shearing edge at the bottom. A chain with bits forms the floor of the hopper. The chain is on a boom. Drive means drives the chain so that the bits move towards the shearing edge. The moving bits cooperate in reducing material conveyed on the chain and cooperate further with the shearing edge to reduce the material to a predetermined size.

13 Claims, 4 Drawing Sheets

50
40
52
42
26
24
36
32
34
46
4
18
20
6

MATERIAL REDUCER

BACKGROUND OF THE INVENTION

Environmentalists have raised a consciousness concerning the contamination of our environment with unsightly and virtually uncontrollable depositing of waste and debris usually at designated landfill sites. This debris may come from many sources including demolition sites, razing or gutting of existing buildings, land clearing areas, manufacturing and construction sites to mention a few.

One of the major problems and disadvantages that exist with respect to current landfill, sites include fires, many of which are fanned by underground tunnels of air caused by the bulkiness and large size of the debris. Fires of this type are generally very difficult to contain and to extinguish.

Another serious problem with respect to landfill sites is the slowness and the uncontrollable nature of the degradation of the debris also caused by the bulkiness and large size of many of the items deposited at these sites.

There have been attempts to solve the handling of waste and the landfill problems, but most have been ineffectual. For example, at many building construction and demolition sites, compactors often times receive the building debris. While compaction of this material does to some extent reduce its bulkiness, it does not reduce the size or bulkiness of the individual items. At best, compaction merely reduces the amount of air space. Compaction of debris is not an effective solution to landfill problems.

Certain machinery has been proposed for reducing the size of debris, but these machines have their limitations, particularly in terms of efficiency, power requirements, lack of speed, and in many instances, the inability to handle relatively large pieces of debris. Some of the known existing machinery includes "SLASHBUSTERS" offered by D & M Machine Division Inc., Montesano, Washington, "STUMPMASTER" marketed by Stumpmaster, Inc., Rising Fawn, Georgia and the M80 Grapple Loading Portable Universal Refiner marketed by Universal Refiner Corporation, Montesano, Washington. Augers have also been proposed but usually require too much power and cannot reduce relatively large size waste materials. Machines of the foregoing type only have limited application at best and are unable to completely resolve the landfill problems which require the ability to handle all types and sizes of debris and reduce it to a size manageable for landfill areas that would enhance the biodegradation process.

SUMMARY OF THE INVENTION

The principal object of the present invention is to provide apparatus for reducing building waste and debris to a size acceptable for use as fill material for landfill sites, so that it can be readily decomposed, the resultant material being more environmentally acceptable.

Another object is to provide a material reducing apparatus of the foregoing type requiring less power for more effective shredding and grinding action.

A further object is to provide a material reducing apparatus of the foregoing type that possess a "live floor" that keeps chewing and reducing debris to an acceptable size.

An important object is to provide a material reducing machine of the foregoing type that is capable of accepting any type material including any metallic, plastic and rubber objects, including objects of relatively large size.

Another important object is to provide a material reducing machine that is mobile, can be transported on a trailer and can be located at a building or demolition site or a landfill for receiving materials at these locations and reducing it in size; and such reducing machine is so effective that a pile of loose material discharged by this machine is relatively more sightly and acceptable to environmentalists.

Objects and advantages will become apparent from the following detailed description, which is to be taken in conjunction with the accompanying drawings.

DETAILED DESCRIPTION

Figure 1:
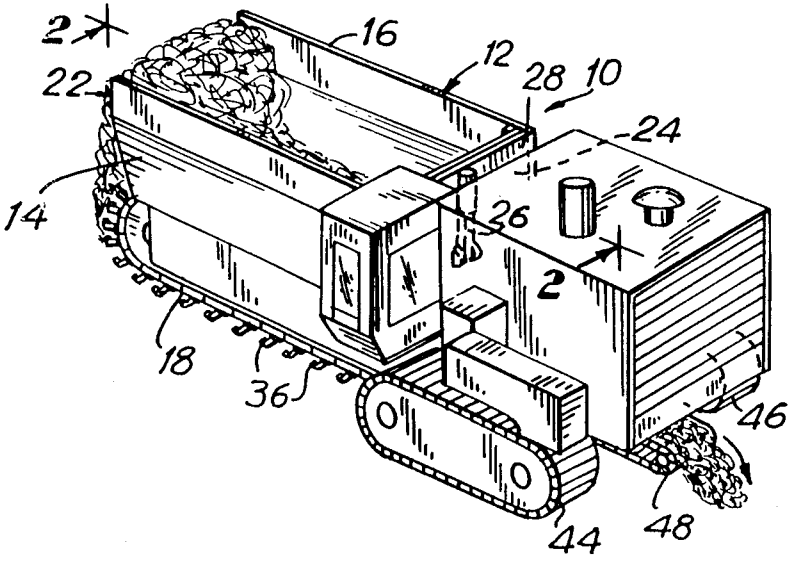
FIG. 1 is a perspective view of a material reducing apparatus incorporating the teachings of the present invention in which debris is loaded into the top of hopper from above.
Figure 4:
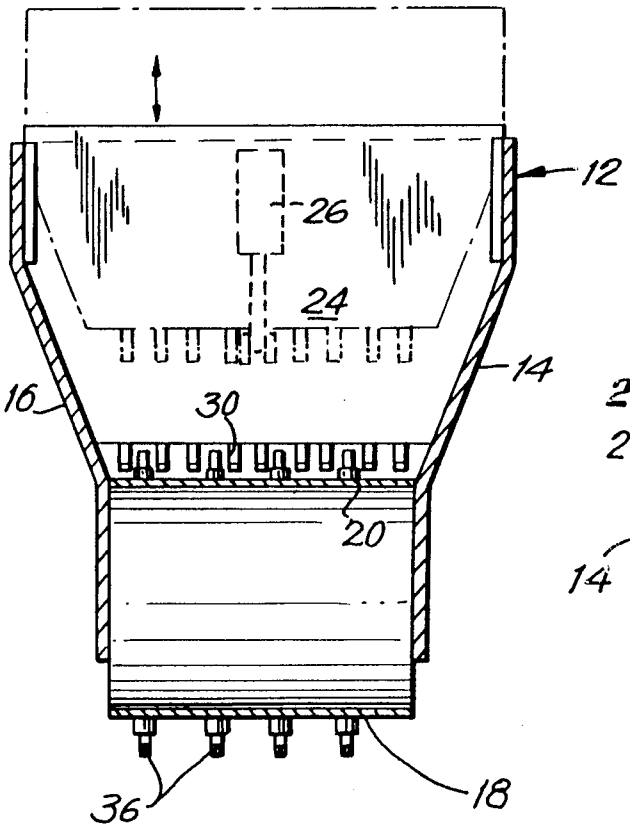
FIG. 4 is a cross-sectional view taken along the line 4—4 of FIG. 2.

In the drawings, the material reducing apparatus 10 includes a hopper 12 for receiving debris and waste material, which as shown in FIG. 1 may be loaded from the top. The hopper is provided with side walls 14 and 16, welded or otherwise secured to the boom 18 rotatably mounting an endless chain 20, which defines a movable floor of the hopper 12. In the embodiment of FIG. 1 front end 22 is open. By keeping the front end open, material that cannot be shredded or ground could very easily be removed from the hopper 12 by simply reversing the rotation of the chain 20 in the manner to be described. On the other end, the front end 22 may be closed and capable of being moved up and down vertically by a hydraulically operated piston of conventional construction. It is also contemplated that this front wall 22 can also be pivotal down towards the base of the hopper 12 to serve as a compacting member for the debris in the hopper 12 to facilitate its reduction. Compaction of the material travelling on the chain 20 expose it more to the grinding and shredding action of the cutting bits on the chain 20 as will become more evident shortly.

The rear end 24 of the hopper 12 is movable up and down vertically by means of a hydraulic cylinder 26, which for convenience may have its cylinder anchored to a cross-bar 28 and its piston rod attached to the movable plate 24. The base of the plate 24 is provided with a shear bar 30 of hardened material that will cooperate with the chain 20 in reducing the debris by a chewing type action by interposed cutting bits in a manner to be described in detail shortly.

The chain 20 is provided with plates 32 on which are mounted blocks 34 which receive bits 36. These bits may be of any suitable type for the material reducing operation selected. In certain applications, flat cutter bits have proven to be satisfactory.

Figure 2:
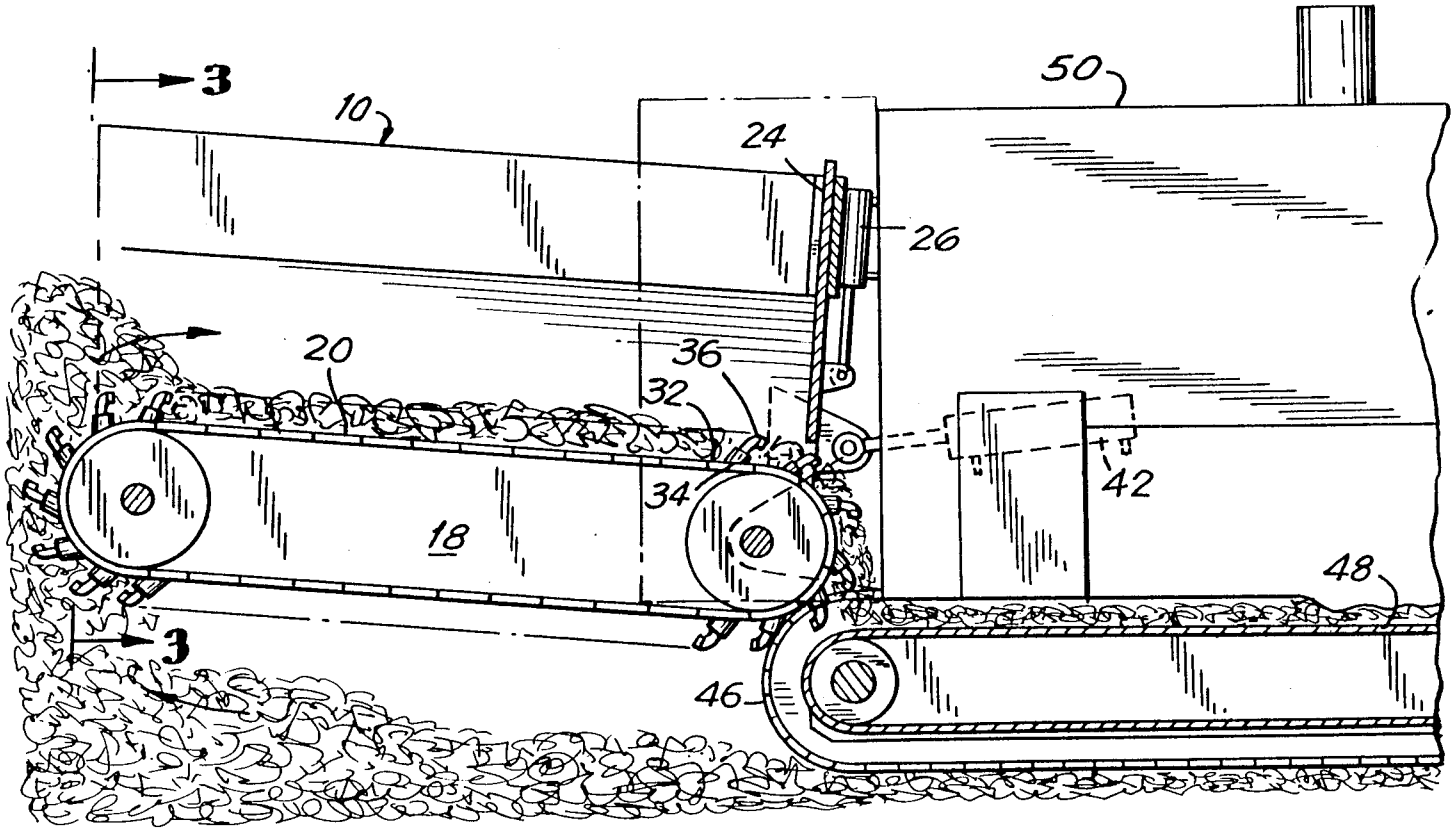
FIG. 2 is an enlarged longitudinal sectional view of the apparatus with certain parts removed.
Figure 3:
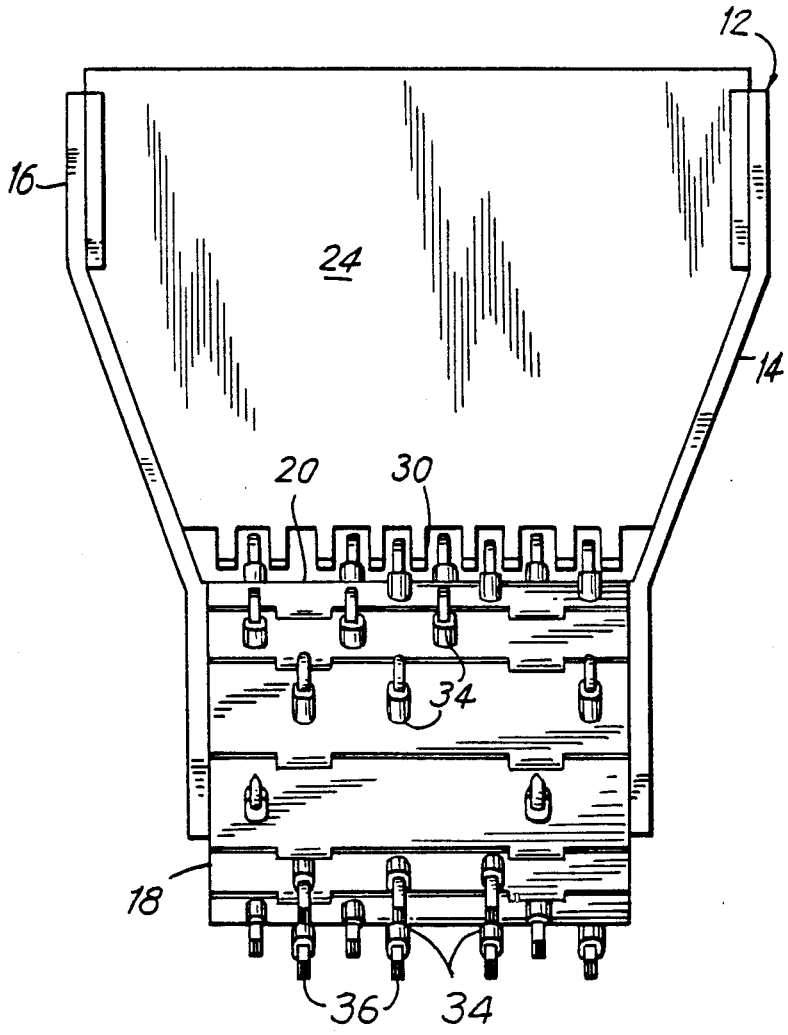
FIG. 3 is an end view thereof.
Figures 5, 6:
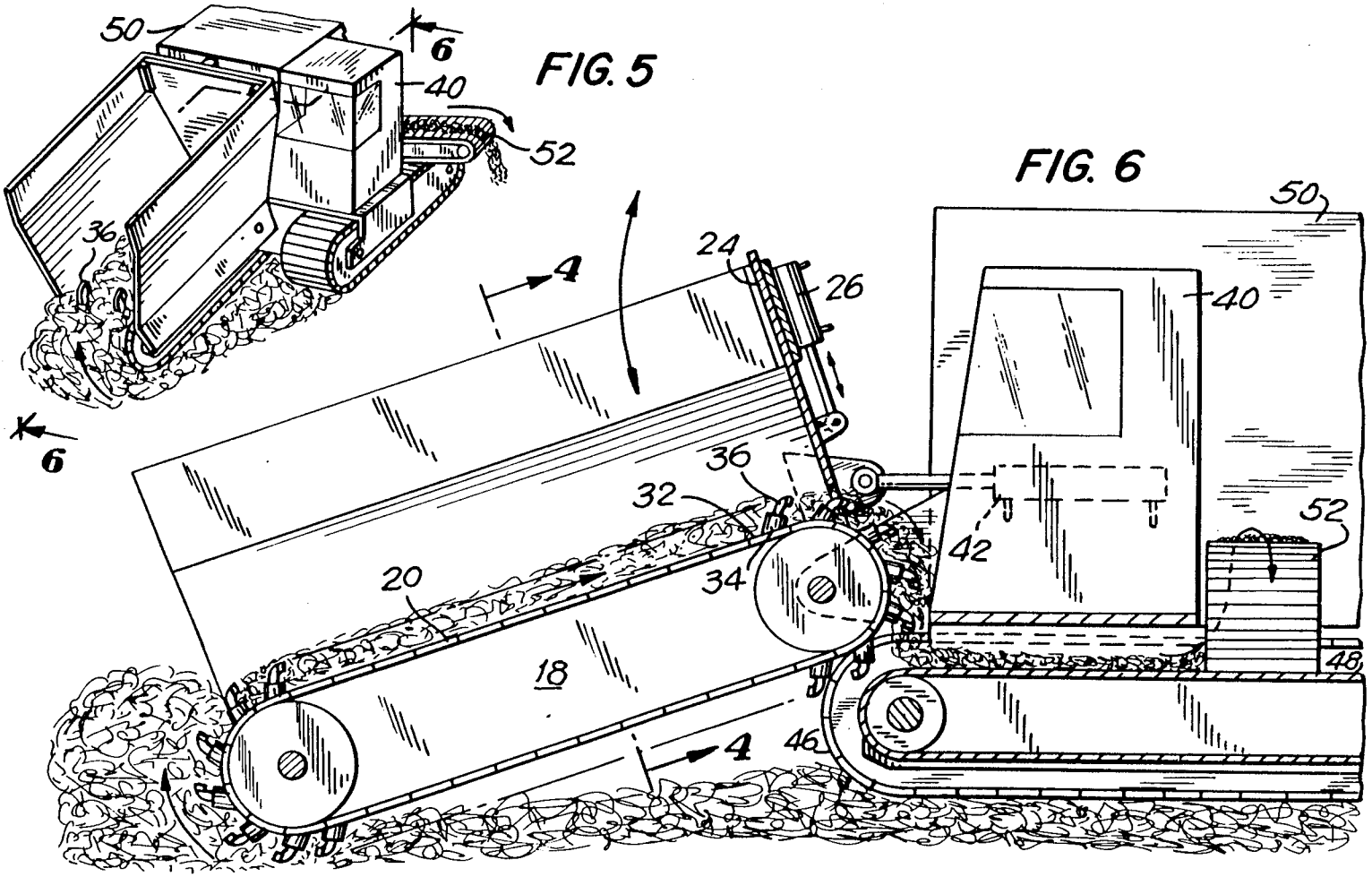
FIG. 5 is a perspective view showing the apparatus handling debris on the ground.
FIG. 6 is a longitudinal section of the apparatus shown in FIG. 5 with certain parts removed.

The construction and operation of the boom 18, chain 20, blocks 34 and bits 36 may be of the type utilized in the Vermeer T-850 Trencher manufactured and marketed by Vermeer Manufacturing Company, Pella, Iowa. The principal difference in the construction and operation is that the chain according to the present invention operates in a clockwise direction as shown in FIGS. 2 and 6 with the blocks 34 and bits 36 facing in a rearwardly direction towards the shear bar 30 which is opposite to that normally employed in the trencher.

In operation, the debris that is loaded into the hopper and engages with the bits 36 on the chain 20 is immediately exposed to a chewing or shredding operation. The material reduction to the proper selected size is finalized when this material passes under the shear bar 30. The size of the reduction in material depends on the position of the shear bar 30 relative to the bits 36. The raising and lowering of plate 24 adjusts the distance between the bottom edge of shear bar 30 and the chain 20 with the teeth 36 cooperating in arriving at the desired size of material to be reduced.

In order to further enhance the shredding and reduction operation, the bottom of the shear bar 30 may be provided with teeth 38 which may be similar to teeth 36 but facing in the opposite direction. These teeth 38 will cooperate with teeth 36 to further reduce the debris to the desired size and also renders the shredding operation more efficient.

As will also be noticed, the boom 18 is inclined slightly towards the base of the shear bar 30 to further drive the debris into the final shredding zone immediately beneath the shear bar 30. The urging of the material in this direction is continuously being down as a result of the continuous movement or rotation of the chain in a clockwise direction, driving material into the cutting zone.

An operator is advantageously located in the cabin 40 within which are located the controls for chain 20, the hydraulic cylinder 26 and a hydraulic cylinder 32 which facilitates the raising and lowering of the boom 18 for purposes of which will become evident shortly. In addition the operator will be able to maneuver the apparatus 10 from one location to another through the operation of tracks 44 and 46. A movable conveyor 48 advantageously receives the shredded material from the chain 20 that passes beneath the shear bar 30 and transfers it in the disclosed embodiment rearwardly to the selected site for eventual removal and relocation to another place. As is the case with the trencher identified in the above all moving parts may be driven from the diesel engine 50.

Referring now to FIGS. 5 and 6, it will be observed that in certain instances it may be desirable not to top load the hopper 12 but to lower boom 18 and back the trailing end of the chain 20 into a pile of debris or selected part of a landfill site to further reduce the debris in size. Towards this end, the rotation of the chain 20 with the cutter bits 36 thereon will act to dislodge and lift debris on to the top surface of the chain 20. As the desired amount of debris is reduced in size the operator merely maneuvers the material reducing apparatus 10 by maneuvering the tracks 44 and 46 in a conventional manner.

In this embodiment, the debris that is reduced in size instead of being conveyed by conveyor 48 to a location at the rear end of the apparatus 10 as in FIGS. 1-4 is moved laterally on a conveyor 52 that receives the reduced debris. Lateral conveyors of this type, their construction and operation appear on the commercially available trencher identified in the above.

As previously explained, only certain size materials will be permitted to go under the shear bar 30 and its height relative to the chain 20 will determine the size of the material passing through this reducing zone. The efficiency of the shredding or reducing operation is determined by the cutter teeth 36 either alone or in cooperation with the stationary cutter bits 38. From time to time there will be objects that will be picked up by the chain 20 incapable of being ground or shredded. In this case, the operator merely reverses the rotation of the chain 20 to effectively remove this object from the hopper and from the reducing zone.

In actual practice, the reducing of the debris occurs throughout the entire floor or top surface of the chain 20 because of the teeth appearing thereon start the chewing or reducing operation along the entire length of the chain with the final shredding occurring at the shear bar.

Another significant advantage of the present invention is the ability to replace the cutter bits 36 and when worn or when a different reducing action is desired which may dictate that a cutting tool or a busting tool be employed. Another significant advantage is the fact that the apparatus can handle mixed variety of debris without changing the instruction or operation thereof. Compared to prior art apparatus the apparatus of the present invention is many times faster in its reducing operation because the area and speed of cutting is greater and it possesses a larger cutting surface. Furthermore the present invention takes advantage of utilization of a chain with cutting tools which is a proven cutting technique as well as a technique for moving material.

The sloping nature of side walls 14 and 16 contribute to and facilitate the proper feeding of the debris downwardly on to the chain 20.

There are many different forms of loading of the hopper 20 that are contemplated and it should be understood that many variations thereof are possible including chutes, bucket loaders, conveyors, feed rollers and essentially any other type of feeding mechanism that places debris on the chain 20 and forces it into the shearing area.

While the contemplated engine 50 is of the type employed in the trencher identified in the foregoing, because of the power available, if it is found that less power is needed, smaller engines may be employed.

Thus, material reduction and shredding operation of the present invention enhances the degradation of the waste being handled. In actual practice the original volume of waste is reduced to only a small percentage of the original volume and two inch reduced material has been obtained in specific application.

As explained the apparatus of the present invention can reduce essentially all waste material whether it be tree stumps, wood, paper, plastic, rubber or metallic products, demolition waste, mill waste, log yard waste and cut stock waste.

Thus the several aforenoted objects and advantages are most effectively attained. Although several somewhat preferred embodiments have been disclosed and described in detail herein, it should be understood that this invention is in no sense limited thereby and its scope is to be determined by that of the appended claims.

We claim:

1. A material reducing apparatus for reducing the size of waste material and debris of land fills, demolition sites, razing and gutting existing buildings, land clearing areas, manufacturing and construction sites and the like comprising: a hopper having a pair of opposed sides, a front end and a back end, the back end having a top and bottom and a shearing edge at the bottom, said shearing edge being substantially horizontal and being stationary during the reducing operation, a boom, a chain on the boom, the chain forming the floor of the hopper, bit means on the chain for cooperating in shredding and chewing the material to be reduced, drive means coupled with the chain for driving the chain so that the bit means moves towards the shearing edge, whereby the moving bit means cooperates further with the shearing edge to reduce the material to a predetermined size, the reducing of the material occurring substantially throughout the floor of the hopper by the bit means on the chain with the final shredding and chewing of the material occurring at the shearing edge.

2. The invention in accordance with claim 1 wherein means are provided for raising and lowering the boom and consequently the angle of the chain driven towards the shearing edge.

3. The invention in accordance with claim 1 wherein the sides of the hopper are secured to the boom.

4. The invention in accordance with claim 1 wherein the front end of the hopper is open.

5. The invention in accordance with claim 1 wherein the back end includes a shear bar at the bottom having the shearing edge.

6. The invention in accordance with claim 5 wherein the back end is movable up and down to raise and lower the shear bar relative to the chain and consequently the size of the shear area therebetween thereby determining the size of the material reduced.

7. The invention in accordance with claim 6 wherein spaced cutter bits extend downwardly from the shearing edge and face towards the front of the hopper.

8. The invention in accordance with claim 6 wherein spaced cutter bits extend outwardly from the chain and as the chain cutter bits approach the shearing edge they face the shearing edge and the cutter bits cooperate in providing an efficient reduction of the material.

9. The invention in accordance with claim 1 wherein spaced cutter bits extend downwardly from the shearing edge and face towards the front of the hopper.

10. The invention in accordance with claim 9 wherein spaced cutter bits extend outwardly from the chain and as the chain cutter bits approach the shearing edge they face the shearing edge and the cutter bits cooperate in providing an efficient reduction of the material.

11. The invention in accordance with claim 1 wherein a driven conveyor conveys the reduced material passing under the shearing edge away to a selected location.

12. The invention in accordance with claim 1 wherein the apparatus includes driven tracks rendering the apparatus mobile.

13. A material reducing apparatus for reducing the size of waste material and debris of land fills, demolition sites, razing and gutting existing buildings, land clearing areas, manufacturing and construction sites and the like comprising a hopper having a pair of opposed sides, a front end and a back end, the back end having a top and a bottom and a shearing edge at the bottom, the back end being vertically adjustable, said shearing edge being substantially horizontal and being substantially stationary in the horizontal direction during the reducing operation, a boom, a chain on the boom, means for raising and lowering the boom in order to adjust the angle of the boom and consequently the angle of the chain with respect to the vertical plan, the chain forming the floor of the hopper, bit means on the chain for cooperating in shredding and chewing the material to be reduced, drive means coupled with the chain for driving the chain so that the bit means moves toward the shearing edge, whereby the moving bit means cooperates in reducing material conveyed on the chain and cooperates further with the shearing edge to reduce the material to a predetermined size, the reducing of the material occurring substantially throughout the floor of the hopper by the bit means on the chain with the final shredding and chewing of the material occurring at the shearing edge.

* * * * *